US005105832A

United States Patent [19]

Tassé

[11] Patent Number: 5,105,832

[45] Date of Patent: Apr. 21, 1992

[54] ASHTRAY

[76] Inventor: Gilles Tassé, C P 381, Papineauville, Quebec, Canada, J0V 1R0

[21] Appl. No.: 666,258

[22] Filed: Mar. 8, 1991

[51] Int. Cl.[5] ..... A24F 13/22; A24F 19/00

[52] U.S. Cl. ..... 131/242.6; 131/240.1; 131/241

[58] Field of Search ..... 131/329, 231, 240.1, 131/241, 242.6, 257

[56] References Cited

U.S. PATENT DOCUMENTS 1,639,760 8/1927 Wise, Jr. ..... 131/242.6 X 2,193,486 3/1940 Litschgi ..... 131/242.6

*Primary Examiner*—V. Millin

*Assistant Examiner*—J. Doyle

*Attorney, Agent, or Firm*—Robert M. Phipps

[57] ABSTRACT

An ashtray is disclosed of the kind including a container with extinguishing liquid or particulate material. The top of the container has a grid of a series of inclined ribs forming a venetian blind like structure. The rim of the grid has specially designed rest means which allows the placement of a smoked but not yet finished cigarette or the like only at a predetermined position relative to the ribs. The ribs are spaced from each other a distance sufficient to allow the rolling therebetween of a finished cigarette or the like down into the container. The ribs being flat and inclined, they obstruct the view of the unsightly interior of the container and thus provide a more pleasing overall appearance of the ashtray.

3 Claims, 2 Drawing Sheets

ASHTRAY

The present invention relates to ashtrays, and in particular to ashtrays provided with or forming a receptacle for collecting and extinguishing lit cigarettes and cigarette or cigar butts and the like.

BACKGROUND OF THE INVENTION

It is well known that conventional ashtrays are both unsightly and sometimes noxious. Further, mild air currents, for instance those generated by overhead fans, are apt to cause ashes to disperse around the ashtray. Discarded cigar or cigarette butts which are not completely extinguished can smoulder for an extended period of time creating an odour or even a fire. In order to put out a cigar or cigarette, one has to crush the lit end in the ashtray, which sometimes may soil or even burn ones fingers.

Some prior art devices have attempted to solve a few of these problems by providing a water trap in which the waste is collected. Some of these devices, however allow cigars or cigarettes rested thereon to accidentally roll off, thereby prematurely extinguishing them in the water. Many of these extinguishing devices are displeasing to the eye as they do not sufficiently obstruct the view of the interior of the container, thus showing the extinguished butts and other smokers' waste floating on the surface of the extinguishing liquid, usually water or a mixture of water and a detergent. Attempts to remove this drawback resulted in a further problem, namely that a large amount of ash is retained on the grating. This is aesthetically displeasing and odorous.

It is consequently desirous to provide an effective means of extinguishing a lit cigar or cigarette, that is both safe, relatively free from odour, easy to manufacture, simple to clean and aesthetically pleasing.

SUMMARY OF THE INVENTION

In general terms, the invention provides an ashtray for receiving ashes, cigar or cigarette butts and the like smokers waste comprising:

a) a container having a bottom wall portion, a sidewall portion and a top portion, the container defining an opening at said top portion;

b) grid means disposed over said opening and comprising a plurality of flat, elongated ribs generally equidistantly spaced from each other and having each a normally generally horizontal top edge, a first face, an opposed, generally flat second face generally parallel with the first face, and a lower edge, the distance between the upper and lower edges defining the width of each respective rib;

c) rest means for supporting a portion of a lit cigar or cigarette thereon, with a lit end of the cigar or cigarette disposed above or resting on said grid means;

c) the spacing between adjacent ribs being sufficient to allow passage of a cigarette or cigar butt therebetween, but being small enough to prevent a lit cigar or cigarette supported by said rest means and by the grid means from falling into the container;

d) the ribs being so arranged as to provide that the first faces of said rib shield the interior of the container from the view of a user when the ashtray is in normal use.

BRIEF DESCRIPTION OF THE DRAWINGS

In order that the present invention may be fully understood, it will now be described by way of example with reference to the accompanying simplified, diagrammatic drawings, in which.

DETAILED DESCRIPTION OF THE PREFERRED EMBODIMENT

Figure 1:
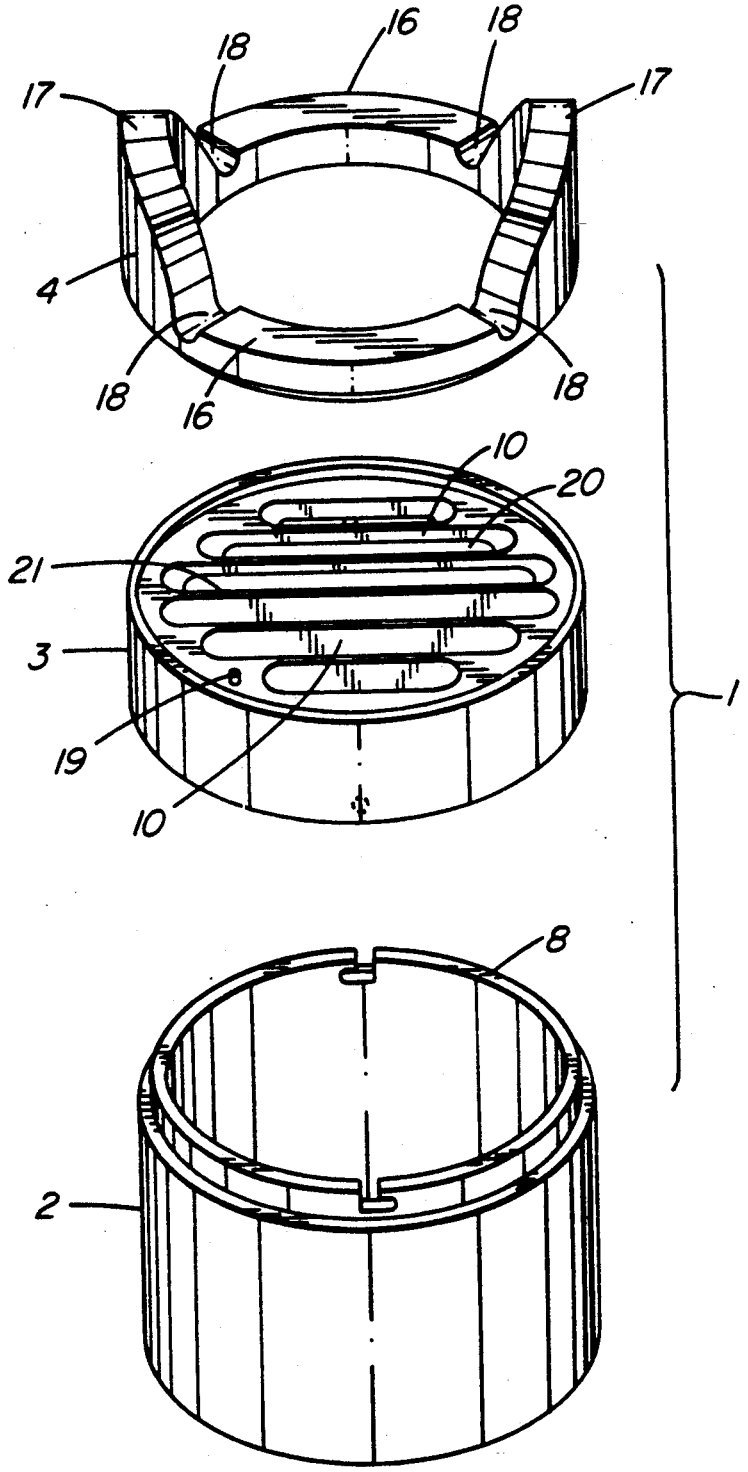
FIG. 1 is an isometric exploded view of a prototype of the present invention.

Referring to FIG. 1, an ashtray according to the present invention is indicated generally by numeral 1. The ashtray comprises an upright collector or container 2, grid means 3 and a cigarette rest 4. In use, the container 2 is partially filled with a liquid (not shown in the drawings) such as water or a detergent or any suitable odour retardant for extinguishing lit butts or the like.

Figure 2:
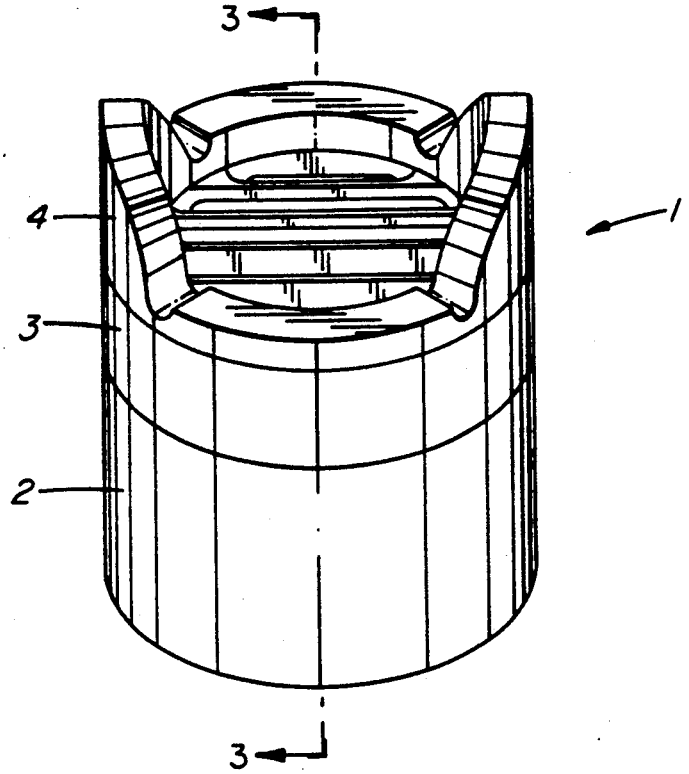
FIG. 2 is an isometric view of the prototype as assembled.
Figure 3:
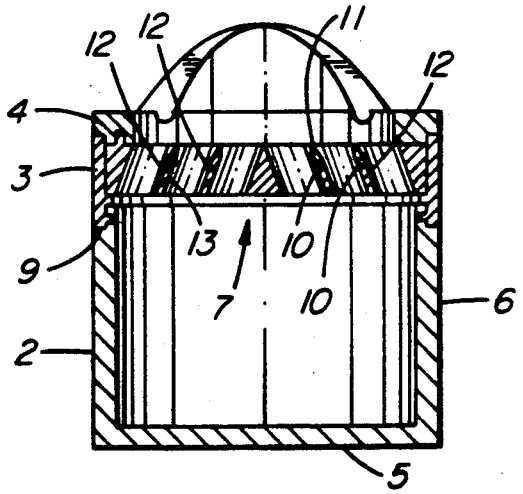
FIG. 3 is Section III—III of FIG. 2.

Referring to FIGS. 2 and 3, the container 2 is a hollow vessel. In the embodiment shown, it has a circular bottom wall portion and a cylindric sidewall portion 6. The top portion of the container defines an opening 7. The container 2 may be a self standing container or it may be mounted to a wall or the like.

The embodiment shown has a separate grid means 3 positioned over the top opening 7 of the container. This is achieved by the upper rim 8 being stepped to provide a ledge complementary with the underside 9 of the grid 3.

The grid 3 may have many different configurations. In the embodiment shown, it is a flat cylindrical disk having an outer diameter of the same size as the cylindrical container 2. The grid 3 has a plurality of generally flat, elongated ribs 10. The drawings show that the ribs 10 are straight and are generally equidistantly spaced from each other. Each rib has a horizontal top edge 11. The ribs 10 are inclined and display each an upper or first face 12 and a lower or second face 13. Reference numeral 14 denotes the lower edge of each rib 10. The distance between the top and bottom edges 11, 14 determines the width of the respective rib.

The spacing 15 (FIG. 4) between adjacent ribs is about 15 mm (slightly more than ½"). This spacing is preferred as it presents a sufficient density of the grid to serve as a support for the lit ends of cigarettes or cigars while, at the same time, it allows the passage of cigarette butts and ashes between the adjacent ribs 10 into the container 2. At the same time, the spacing was found to be small enough to sustain the function of the top edges 11 to serve as a reliable support surface for lit ends of cigarettes or the like, as long as they are maintained with their elongation transversely to the elongation of the ribs 10. To this end, the ring-shaped rest 4 of the embodiment shown presents four distinct portions: two rest portions 16 (also referred to as "rest means") and two obstacle portions 17. The rest portions 16 present an embodiment of what is generally referred to as "rest means", while the portion 17 are "obstacle means". In the embodiment shown, the obstacle means 17 serves dual purpose; it prevents the placement of the cigarette or the like on the periphery of the top of the ashtray in a position parallel to the ribs 10. By the same token, being solid and non-transparent, the obstacle means 17 of the embodiment shown serves the purpose of obstructing the view of the grid of ribs 10 from the ends of the ribs thus obstructing the view of the interior of the container and of the waste stored therein. Four cigarette supporting notches 18 are provided at points of transition between the rest means 16 and the obstacle means 17.

Referring briefly to FIG. 1, item 19 is a locking pin 19 which is complementary with a locking recess (not shown in the drawings) provided at the underside of the rest 4. The pin 19 and the recess are designed to allow interengagement between the grid 3 and the rest 4 such that the obstacles 17 are disposed at the ends of the slots 20 defined by the ribs 10. The rest means 16, on the other hand, are disposed to the sides of the ribs 10 so that, in use, they support the lit cigarettes or cigars in a position in which the longitudinal axis of the cigarette or the like is transverse to the elongation of the ribs 10. The obstacles 17, of course, prevent the placement of a lit cigarette or the like, forcing the user to use the rest means 16. Thus, the user cannot place his cigarette on the rest 4 in a position parallel with the elongation of the ribs 10.

Figure 4:
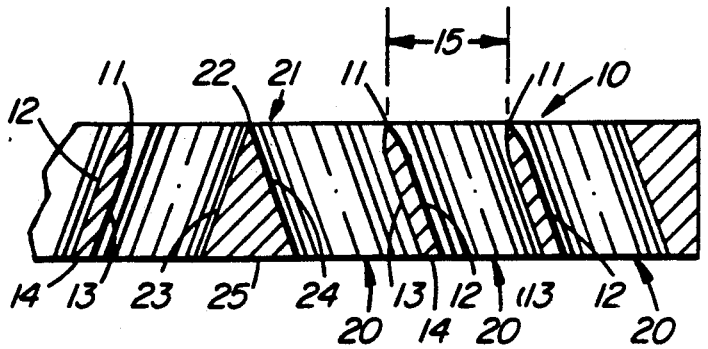
FIG. 4 is an enlarged portion of the view of FIG. 3.

A central rib 21 parallel with the elongation of ribs 10 is of a triangular cross-section. It has an upper edge 22 two oppositely sloping side walls 23, 24 and an underside 25 (FIG. 4). The slope of the faces 23, 24 is parallel with the inclination of the second faces 13 of the adjacent ribs 10.

It is preferred that the faces 12, 13 of the ribs 10 display an inclination to the horizontal of about 50° to 90°. This provides a venetian blind effect obstructing the view of the contents of the container when the top of the ashtray is viewed in the direction transverse to the elongation of the ribs 10. At the same time free passage of smokers ' waste through the grid is allowed. The actual angle of inclination depends on the level at which the ashtray is normally to be placed. It will be steeper in cases where the level of the grid 3 in use is relatively close to the level of the eyes of the user (e.g. wall mounted units) and shallower for ashtrays placed more substantially below the eyesight level of the user, e.g. on a table. The width of the ribs 10 is also variable and can be selected to further improve the concealing function of the ribs 10. The prototype shown in the drawings appears to provide a sufficient visual improvement for use at an elevated level such as in the bars where the to of the bar surface is relatively close to the eye level of the guests. I have found out that ribs having the inclination at an angle of less than 50 degrees tend to catch small pieces of waste preventing them from falling into the container.

Another optional feature of the invention is in making the top edges 11 of the ribs sharp so that the horizontal edges 11 are very narrow, blade-like portions which cannot support pieces of ashes or the like, allowing them to roll down into the container.

Those skilled in the art will appreciate that the prototype described above can be modified to a greater or lesser degree without departing from the scope of the present invention. For example, certain wall mounted units may have the ribs arcuate rather than straight. The inclination and width of the ribs are variables which may be substantially different from those shown in the drawings. The actual structural arrangement may be different and does not have to have the rest means separate from the grate. The container may be provided with an inlaid tray to facilitate the cleaning of the ashtray.

The above examples are but a few indications of departures from the embodiment described, falling within the scope of the invention. Accordingly, I wish to protect by Letters Patent issued on this application all such embodiments as properly and fairly fall within the scope of my contribution to the art.

I claim:

1. An ashtray for receiving ashes and smokers' waste such as cigar or cigarette butts, comprising:

a) a container having a bottom wall portion, a sidewall portion and a top portion, the container defining an opening at said top portion;

b) a grid disposed over said opening and comprising a plurality of straight, elongated flat ribs equidistantly spaced from each other and having upper edges disposed on a first generally horizontal plane;

c) said upper edges being generally parallel with a longitudinal axis of said grid;

d) each rib including, apart from said upper edge, a bottom edge, a flat first face and a flat second face generally parallel with the first face, said faces being disposed at a steep inclination to the horizontal of about 50° to about 90°;

e) a continuous peripheral rim surrounding said grid, said rim comprising two oppositely disposed longitudinal sections extending generally along said longitudinal axis, one to each side of the axis, and two transverse end sections disposed generally transversely of said longitudinal axis;

f) said longitudinal sections extending each over about one-quarter of the perimeter of the grid and having an upper surface portion generally co-planar with a second generally horizontal plane spaced slightly above the first generally horizontal plane to allow placement of cigarettes or cigars on said longitudinal section across said rim such that the burning end of the cigarette or cigar rests on the grid;

g) said transverse end sections having each an upper surface portion which adjoins the upper surface portions of the respective longitudinal sections, the upper surface portion of the transverse end sections raising steeply arcuately above said second horizontal plane to provide an upwardly arcuately shaped surface which has too steep a slope in the peripheral direction of the rim to support a cigarette, cigar on the respective transverse end section h) the spacing between adjacent ribs being sufficient to allow passage of a cigarette butt, a cigar butt or ashes therebetween, but being small enough to prevent a lit cigar or cigarette supported by said rest means and by the grid means from falling into the container;

f) the ribs being so arranged as to provide that the first faces of said rib shield the interior of the container from the view of a user when the ashtray is in normal use.

2. An ashtray as claimed in claim 1, wherein said grid means includes a straight central rib coincident with said longitudinal axis said central rib having a triangular cross-section defining a sharp top edge, a pair of inclined, generally planar faces and an underside; the first faces of the ribs disposed to each side of the central rib being generally parallel with the adjacent one of the planar faces of the central rib.

3. An ashtray as claimed in claim 1, wherein said transverse end sections are each a solid, non-transparent projection of the rim obstructing the end view of said ribs from ends thereof, thus further obstructing the sight of the interior of said container and a waste that may be present therein.

* * * * *